US010895373B1

(12) United States Patent
Maeda

(10) Patent No.: US 10,895,373 B1
(45) Date of Patent: Jan. 19, 2021

(54) LIGHT PROJECTION DEVICE

(71) Applicant: Ushio Lighting, Inc., Tokyo (JP)

(72) Inventor: Takehiko Maeda, Tokyo (JP)

(73) Assignee: Ushio Lighting, Inc., Tokyo (JP)

( * ) Notice: Subject to any disclaimer, the term of this patent is extended or adjusted under 35 U.S.C. 154(b) by 0 days.

(21) Appl. No.: 16/970,056

(22) PCT Filed: Dec. 20, 2018

(86) PCT No.: PCT/JP2018/047045

§ 371 (c)(1),
(2) Date: Aug. 14, 2020

(87) PCT Pub. No.: WO2019/159530

PCT Pub. Date: Aug. 22, 2019

(30) Foreign Application Priority Data

Feb. 19, 2018 (JP) ..... 2018-026576

(51) Int. Cl.
*F21V 23/02* (2006.01)
*H05B 45/10* (2020.01)
(Continued)

(52) U.S. Cl.
CPC ..... *F21V 23/02* (2013.01); *F21V 11/10* (2013.01); *H05B 45/10* (2020.01); *F21W 2131/406* (2013.01); *F21Y 2115/10* (2016.08)

(58) Field of Classification Search
CPC ..... H01L 2224/32225; H01L 2924/00; H01L 2924/1517; H01L 2224/48227; H01L 2224/73265; H01L 2924/00014; H01L 2224/16225; H01L 2224/73204; H01L 2924/15311; H01L 2224/24227; H01L 2924/00012; H01L 2924/15153; H01L 2224/0401; H01L 2224/13099;
(Continued)

(56) References Cited

U.S. PATENT DOCUMENTS

2015/0155728 A1 6/2015 Feustel et al.

FOREIGN PATENT DOCUMENTS

JP 2010135095 A 6/2010
JP 2011086408 A 4/2011

OTHER PUBLICATIONS

Written Opinion issued in PCT/JP2018/047045; dated Feb. 19, 2019.

(Continued)

*Primary Examiner* — Monica C King

(74) *Attorney, Agent, or Firm* — Studebaker & Brackett PC

(57) ABSTRACT

A light projection device includes a tubular casing having a light-emitting part at one tube end; a light source configured with a light-emitting diode; and a light amount control mechanism positioned between the light source and the light-emitting part. The light amount control mechanism includes a rotating body, an operating part attached to the rotating body such as to allow for rotary operation of the rotating body from outside the casing, a variable resistor, and a link mechanism operably connecting the rotating body and the variable resistor such that a forward movement of the rotating body causes a movable part of the variable resistor to move in a direction in which the amount of current is increased and such that a backward movement of the rotating body causes the movable part of the variable resistor to move in a direction in which the amount of current is decreased.

8 Claims, 6 Drawing Sheets

(51) Int. Cl.
*F21V 11/10* (2006.01)
*F21W 131/406* (2006.01)
*F21Y 115/10* (2016.01)

(58) Field of Classification Search
CPC ..... H01L 2224/92; H01L 2224/92125; H01L 2924/00011; H01L 2924/00013; H01L 2924/01029; H01L 2924/01079; H01L 2924/10253; H01L 2924/12041; H01L 2924/14; H01L 2924/351; H01L 2224/04105; H01L 2224/20; H01L 2224/45015; H01L 2224/45099; H01L 2224/73267; H01L 2224/82; H01L 2224/83; H01L 2224/92244; H01L 23/5389; H01L 24/19; H01L 2924/01005; H01L 2924/01006; H01L 2924/01012; H01L 2924/01013; H01L 2924/01033; H01L 2924/01046; H01L 2924/01078; H01L 2924/09701; H01L 2924/207; H01L 2924/3011; H01L 21/486; H01L 21/6835; H01L 21/76802; H01L 2221/68345; H01L 2223/54486; H01L 2224/1134; H01L 2224/16235; H01L 2224/211; H01L 2224/32057; H01L 2224/76155; H01L 2224/82102; H01L 2224/83385; H01L 2225/06517; H01L 2225/06524; H01L 2225/06541; H01L 2225/06572; H01L 2225/06586; H01L 23/49811; H01L 23/49822; H01L 23/49827; H01L 24/24; H01L 24/32; H01L 24/48; H01L 24/73; H01L 25/0657; H01L 2924/01015; H01L 2924/01018; H01L 2924/01019; H01L 2924/0102; H01L 2924/01027; H01L 2924/0104; H01L 2924/01042; H01L 2924/01057; H01L 2924/0106; H01L 2924/01073; H01L 2924/014; H01L 2924/12044; H01L 2924/15174; H01L 2924/15183; H01L 2924/1532; H01L 2924/19041; H01L 2924/19042; H01L 2924/19043; H01L 2924/30107; H01K 1/18; H01K 1/28; H01K 1/44; H01K 1/46; H05K 2201/09563; H05K 2201/09863; H05K 2203/0796; H05K 3/0055; H05K 3/20; H05K 3/421; H05K 3/4644
See application file for complete search history.

(56) References Cited

OTHER PUBLICATIONS

International Search Report issued in PCT/JP2018/047045; dated Feb. 19, 2019.

LIGHT PROJECTION DEVICE

TECHNICAL FIELD

This invention relates to an improvement in a light projection device operated by a lighting technician in concert venues, theater halls, shooting facilities of films or the like, and event venues for weddings, fashion shows and the like.

BACKGROUND ART

Patent Document 1 shows a light projection device having a tubular casing, with one tube end being a light-emitting part for the light emitted from a xenon lamp housed in this casing. The casing is supported on a stand such as to be rotatable around a vertical axis as well as tiltable around a horizontal axis, so that a lighting technician can manipulate the device to direct the light to a desired spot. Between the xenon lamp and the light-emitting part are provided, from the side closer to the xenon lamp, a first cutter device for adjustment of light amount, a second cutter device switchable between a fully open state and a fully closed state, and an iris shutter that adjusts the diameter of the circular light beam emitted from the light projection device. The first cutter device, second cutter device, and iris shutter are all configured such that operating rods sticking out from an upper part of the casing are rotated around the tube axis of the casing so that adjustment of light is achieved mechanically. Specifically, the light emission from the light projection device is stopped when the second cutter device is fully closed. An operation that causes the second cutter device to be in the fully open state allows the light projection device to emit light from the xenon lamp. Manipulating the operating rod of the first cutter device, with the second cutter device being in the fully open state, causes a plurality of blades forming the first cutter device to slide so that the amount of light is adjusted (this first cutter device is also known as "dimming shutter"). Manipulating the operating rod of the iris shutter, with the second cutter device being in the fully open state, causes a plurality of blades forming the iris shutter to slide so that the diameter of the emitted light beam is adjusted.

PRIOR ART DOCUMENT

Patent Document

Patent Document 1: JP-A-2010-135095

SUMMARY OF THE INVENTION

Problems to be Solved by the Invention

The increased power output of light-emitting diodes has made it possible to replace the light source for this type of light projection device with a light-emitting diode. As compared to xenon lamps used as the light source, light-emitting diodes used as the light source can reduce power consumption for about the same output, and lower the heat generated during the operation of the light projection device, and moreover, allow adjustment of the amount of light emitted from the light projection device to be made by increasing and decreasing the amount of current applied to the light-emitting diode. (Adjustment of the amount of light of a xenon lamp, which is a discharge lamp, by increasing and decreasing the amount of current is not feasible since flickering occurs or the lamp eventually turns off unless a current of more than a certain level is applied.)

This type of light projection device having the light source replaced with a light-emitting diode no longer needs the first cutter device and the second cutter device because the functions of the first cutter device and the second cutter device can be achieved by a variable resistor that allows for control of increasing and decreasing the amount of current applied to the light-emitting diode. Considering, however, that the light projection device of the configuration shown in Patent Document 1 has been wide spread and long accustomed to, it is strongly desired that the operating method for adjusting the amount of light emitted from the light projection device and the feeling when operating the device be maintained the same even after replacing the light source of this type of light projection device with a light-emitting diode.

A primary issue that this invention intends to solve is to enable the operating method for adjusting the amount of light emitted from this type of light projection devices that use light-emitting diodes for the light source, and the feeling when operating the device, to be as close as possible to those of light projection devices that use a conventional lamp such as a xenon lamp for the light source.

Means for Solving the Problems

To achieve the object described above, this invention provides a light projection device including a tubular casing having a light-emitting part at one tube end;

a light source configured with a light-emitting diode housed in the casing; and a light amount control mechanism positioned between the light source and the light-emitting part and controlling an amount of light output from the light-emitting part, the light amount control mechanism including a rotating body provided inside the casing and supported on the casing such as to be rotatable around a tube axis of the casing, an operating part attached to the rotating body such as to allow for rotary operation of the rotating body from outside the casing, a variable resistor allowing for current adjustment to increase and decrease an amount of current applied to the light-emitting diode, and a link mechanism operably connecting the rotating body and the variable resistor such that a forward movement of the rotating body causes a movable part of the variable resistor to move in a direction in which the amount of current is increased and such that a backward movement of the rotating body causes the movable part of the variable resistor to move in a direction in which the amount of current is decreased.

In one aspect of this invention, the light source is switched off when the rotating body has been moved to a limit of backward movement.

In one aspect of this invention, the rotating body is formed in an annular shape, with an inner part thereof being a passage part for a light beam from the light source.

In one aspect of this invention, a light beam diameter adjusting mechanism is provided between the light amount control mechanism and the light-emitting part for a light beam emitted from the light-emitting part.

Effect of the Invention

This invention enables the operating method for adjusting the amount of light emitted from this type of light projection devices that use light-emitting diodes for the light source, and the feeling when operating the device, to be as close as possible to those of light projection devices that use a conventional lamp such as a xenon lamp for the light source.

MODE FOR CARRYING OUT THE INVENTION

Hereinafter, a typical embodiment of this invention will be described with reference to FIG. 1 to FIG. 6. The light projection device 1 according to this embodiment is operated by a lighting technician in concert venues, theater halls, shooting facilities of films or the like, event venues for weddings, fashion shows and the like, and used to provide desired lighting effects to a desired lighting target.

This light projection device 1 includes a tubular casing 3 having a light-emitting part 2 at one tube end 3*a* (tube front end), a light source 4*a* configured with a light-emitting diode (hereinafter referred to as LED) housed in the casing 3, and a light amount control mechanism 8 positioned between the light source 4*a* and the light-emitting part 2 inside the casing 3 and controlling the amount of light output from the light-emitting part 2.

Figure 2:
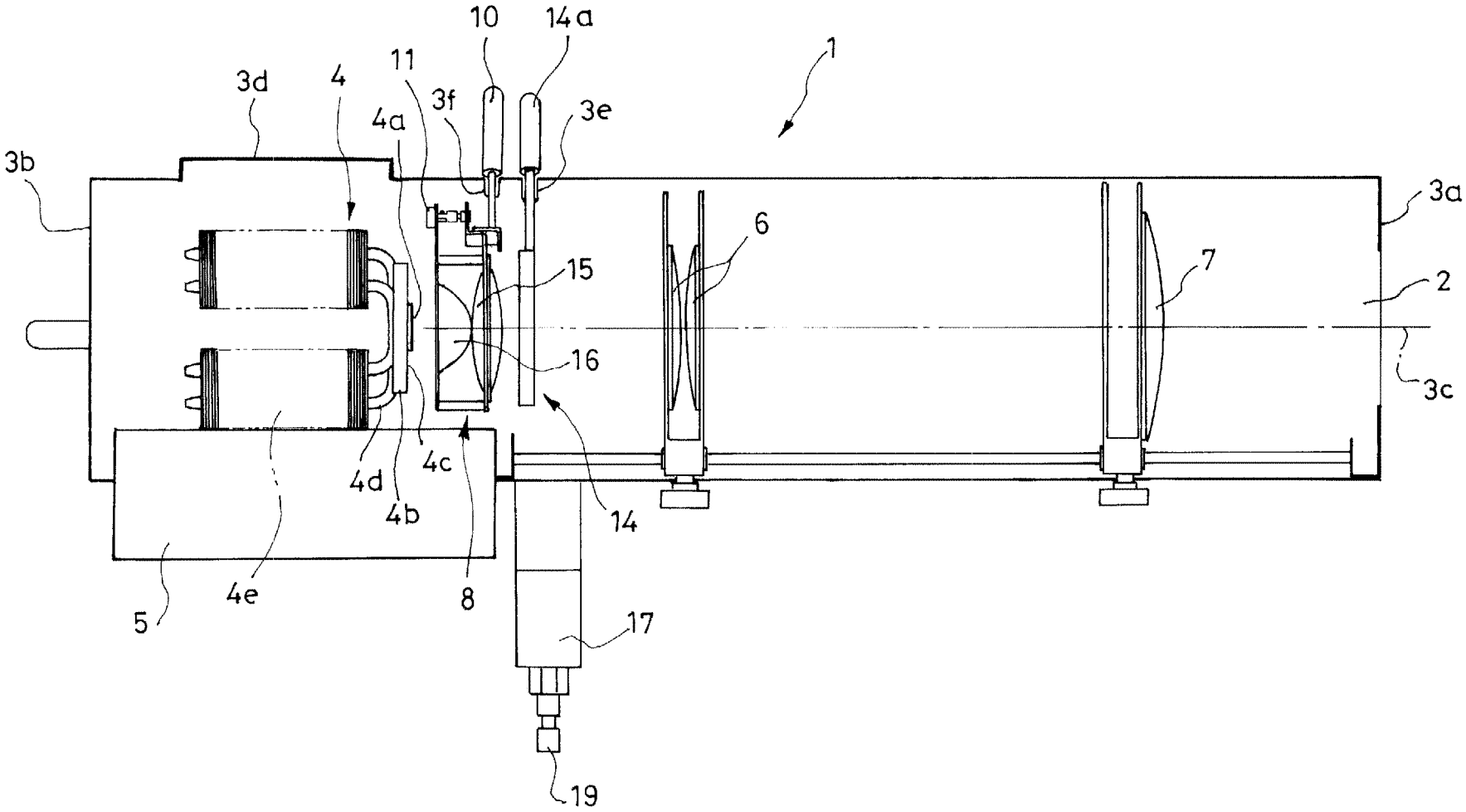
FIG. 2 is a cross-sectional configuration diagram of the light projection device.
Figure 3:
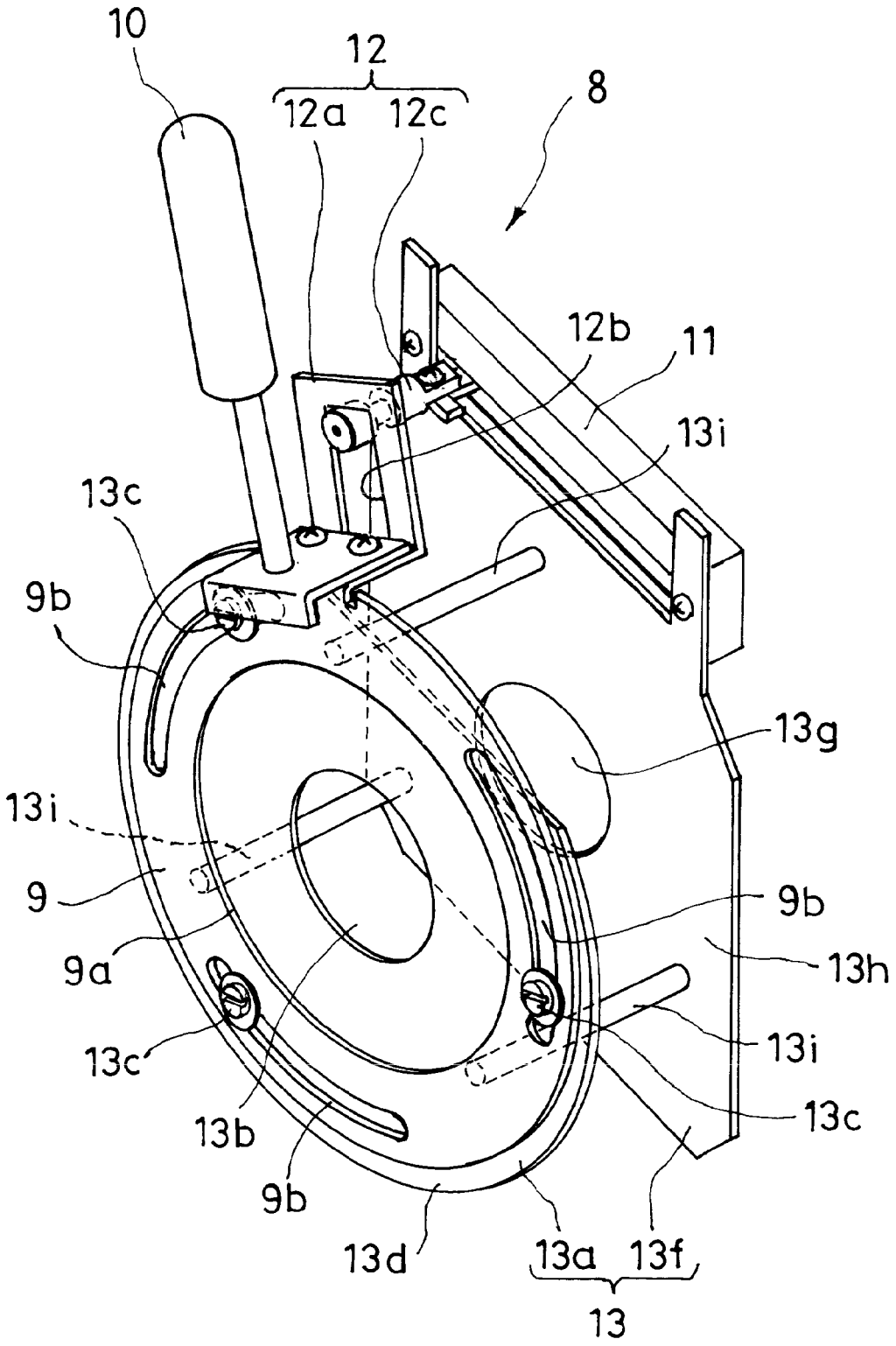
FIG. 3 is a perspective view of a light amount control mechanism that is part of the light projection device.
Figure 4:
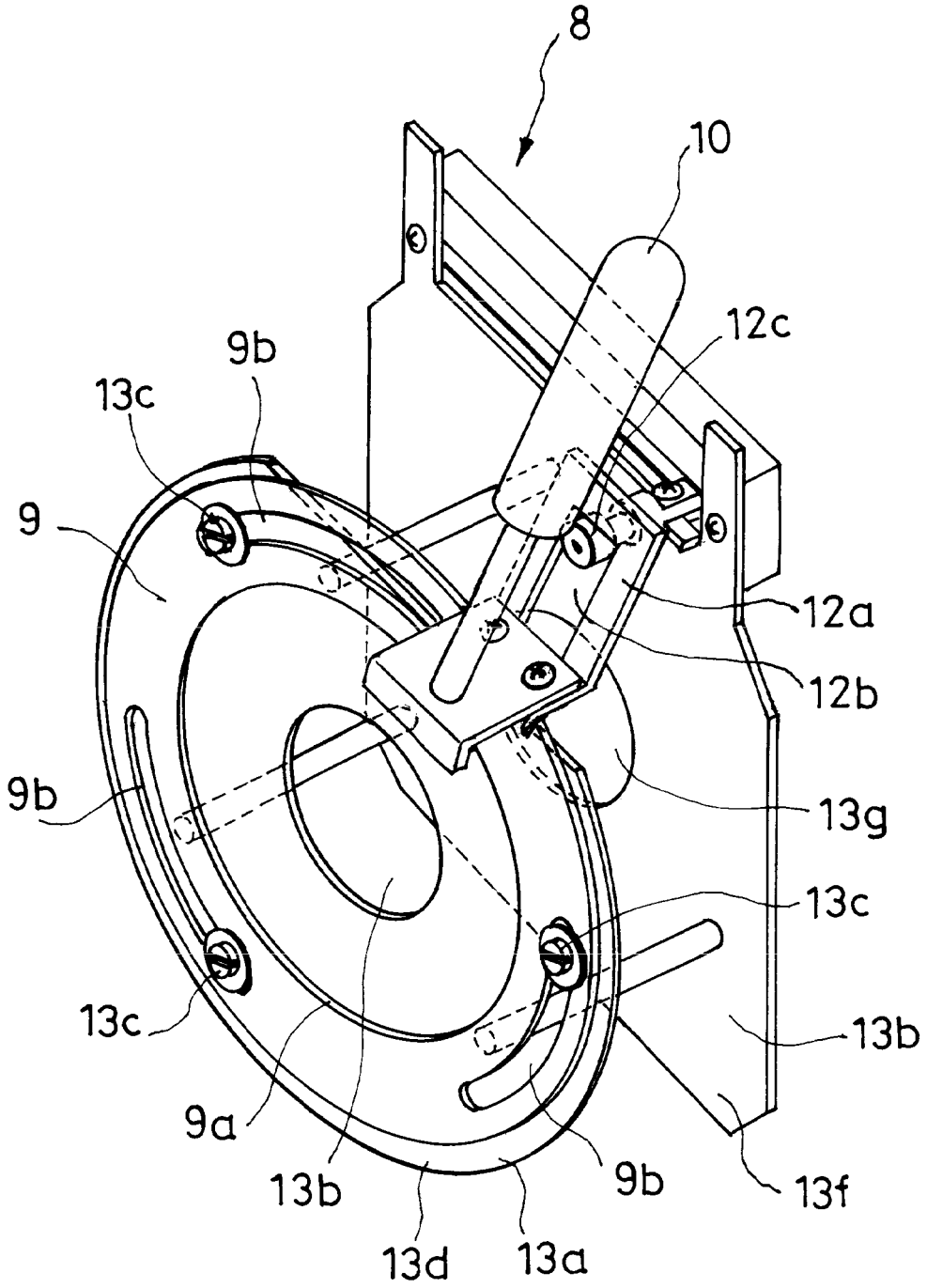
FIG. 4 is a perspective view of the light amount control mechanism that is part of the light projection device, illustrating a state in which a rotating body that is part of the light amount control mechanism has been rotated to a limit of clockwise movement from the state of FIG. 3.
Figure 5:
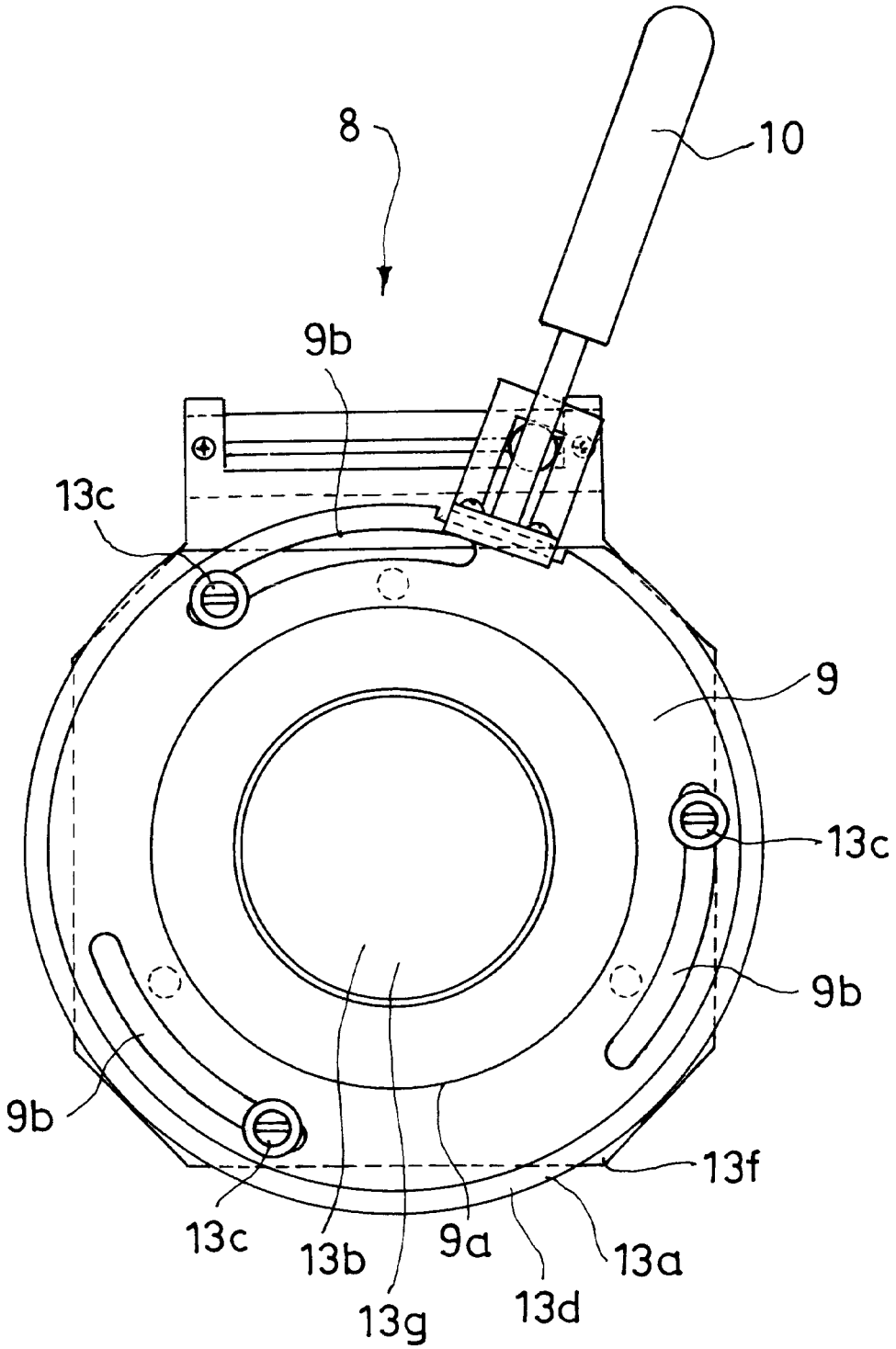
FIG. 5 is a front view of the light amount control mechanism that is part of the light projection device, illustrating a state in which the rotating body that is part of the light amount control mechanism has been rotated to a limit of clockwise movement from the state of FIG. 3.
Figure 6:
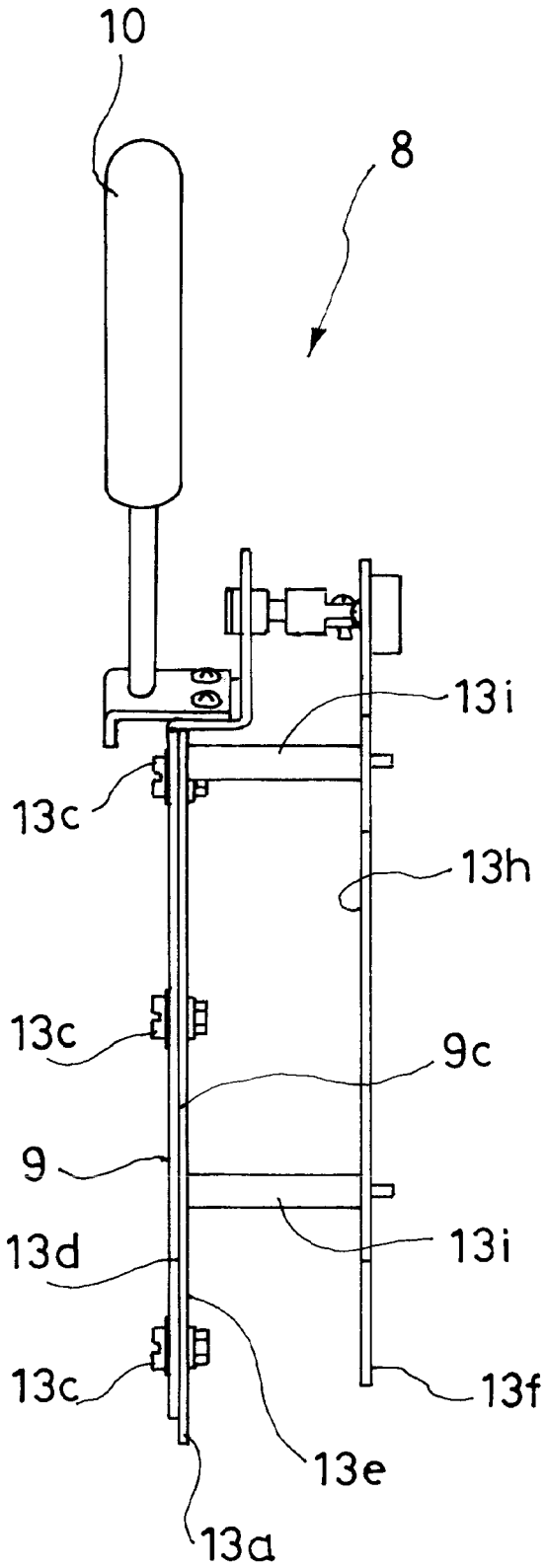
FIG. 6 is a side view of the light amount control mechanism that is part of the light projection device, illustrating a state in which the rotating body that is part of the light amount control mechanism has been rotated to a limit of clockwise movement from the state of FIG. 3.

FIG. 2 illustrates the outline of the configuration of one example of this light projection device 1. One tube end 3*a* of the casing 3 is open, and this open section serves as the light-emitting part 2. The other tube end 3*b* of the casing 3 is closed.

The light source 4*a* is disposed on the side closer to the other tube end 3*b* (tube rear end) of the casing 3. The light source 4*a* is set in the center of a plate-like seat body 4*b* having a front surface 4*c* and a back surface 4*d* orthogonal to the tube axis 3*c* of the casing 3 such that the optical axis substantially coincides with the tube axis 3*c* of the casing 3. Although not shown, the light source 4*a* is configured by an assembly of a plurality of LEDs. A heat sink 4*e* is disposed between the plate-like seat body 4*b* and the other tube end 3*b* of the casing 3, partly joined to the back surface 4*d* of the plate-like seat body 4*b* in a heat-exchangeable manner. This heat sink 4*e* and the light source 4*a* make up an LED unit 4.

Below the LED unit 4 are disposed a power source for the LED unit 4 and a controller unit 5. The casing 3 is formed with an open part 3*d* for heat dissipation above the LED unit 4.

In the illustrated example, a rear lens 6 is disposed substantially in the middle of the entire length of the casing 3, and a front lens 7 is disposed between this rear lens 6 and the light-emitting part 2, inside the casing 3.

The light amount control mechanism 8, and a light beam diameter control mechanism 14 of the emitted light are provided between the rear lens 6 and the light source 4*a* inside the casing 3.

The light beam diameter control mechanism 14 is positioned between the light amount control mechanism 8 and the light-emitting part 2, i.e., in front of the light amount control mechanism 8, in the illustrated example. This light beam diameter control mechanism 14 is configured with a known iris shutter in the illustrated example. This iris shutter includes a movable body (not shown) provided with an operating rod 14*a* sticking out from a slot-like passage hole 3*e* elongated along the circumferential direction around the tube axis 3*c* of the casing 3 in an upper part of the casing 3, and a plurality of blades (not shown) that slide as the movable body is rotated through use of the operating rod 14*a*. Moving the operating rod 14*a* within the range of the passage hole 3*e* rotates the movable body forward or backward around the tube axis 3*c*, these rotating movements of the movable body causing the blades to slide to increase or decrease the diameter of the light beam passed through the iris shutter within a predetermined range.

The light amount control mechanism 8 includes a rotating body 9 inside the casing 3 and supported on the casing 3 such as to be rotatable around the tube axis 3*c* of the casing, an operating part 10 attached to the rotating body 9 such as to allow for rotary operation of the rotating body 9 from outside the casing 3, a variable resistor 11 allowing for current adjustment to increase and decrease an amount of current applied to the LED that forms the light source 4*a*, and a link mechanism 12 operably connecting the rotating body 9 and the variable resistor 11 such that a forward movement of the rotating body 9 causes a movable part (not shown) of the variable resistor 11 to move in a direction in which the amount of current is increased and such that a backward movement of the rotating body 9 causes the movable part of the variable resistor 11 to move in a direction in which the amount of current is decreased.

In the illustrated example, the rotating body 9 is annular, the inside thereof being a passage part 9*a* of the light from the light source 4*a*. In the illustrated example, the rotating body 9 is made from a disc with a circular hole therein that is the passage part 9*a* so that it is annular. Long through holes 9*b* are formed between the outer edge and the inner edge of the rotating body 9 along circular arcs of one imaginary circle having the center coinciding with the center of the rotating body 9. In the illustrated example, through holes 9*b* are formed at three points such that adjacent through holes 9*b* are spaced from each other. The three through holes 9*b* have an equal length.

The operating part 10, in the illustrated example, is in the form of a rod, its lower end being secured to the rotating body 9. The operating part 10 extends out of the casing 3 through a passage hole 3*f* formed in an upper part of the casing 3 for the operating part 10, which makes it possible to manipulate the rotating body 9 from outside the casing 3 using the operating part 10 to rotate the rotating body 9 in a forward direction (for example, clockwise r1, as viewed from the front of the light projection device shown in FIG. 1) in a fixed range, and to rotate the rotating body in a backward direction (for example, counterclockwise r2, as viewed from the front of the light projection device shown in FIG. 1). The passage hole 3*f* is a slot elongated along the circumferential direction around the tube axis 3*c* of the casing 3. Any configuration that allows for rotation of the rotating body 9 from outside the casing 3 will suffice as the operating part 10 and the specific configuration is not limited to the illustrated example.

The variable resistor 11, in the illustrated example, is substantially rectangular as viewed from the front, longitudinally arranged along a left and right direction x (see FIG. 1), and configured to have a movable part (not shown) that is movable in the left and right direction x. Any configuration that allows for current adjustment to increase and decrease the amount of current applied to the light-emitting diode will suffice as the variable resistor 11 and the specific configuration is not limited to the illustrated example.

In the illustrated example, a support member 13 having a front plate member 13*a* supporting the rotating body 9 and a rear plate member 13*f* supporting the variable resistor 11 is secured to the casing 3 so that the rotating body 9 is supported on the casing 3.

The front plate member 13*a* in the illustrated example is a plate member having a passage part 13*b* that is a circular hole in the center for the light beams from the light source 4*a*. On the front surface 13*d* of the front plate member 13*a*, between the outer edge of the front plate member 13*a* and the hole edge of the passage part 13*a*, are guide parts 13*c* that fit in the through holes 9*b* of the rotating body 9, the guide parts being formed by bolts secured to the front plate member 13*a*. There are provided three guide parts 13*c* corresponding to the number of the through holes 9*b*. In the illustrated example, with the guide parts 13*c* each fitted in the through holes 9*b* at three points, the rotating body 9 is joined to the front plate member 13*a* such that the back surface 9*c* of the rotating body 9 is in contact with the front surface 13*d* of the front plate member 13*a*. This way, the rotating body 9 is allowed to rotate within the range of the length of the through holes 9*b*. The back surface 9*c* of the rotating body 9 and the front surface 13*d* of the front plate member 13*a* are in surface contact so that the friction resistance prevents the rotating body 9 from being displaced at respective rotated positions.

The rear plate member 13*f* is a plate member having a passage part 13*g* that is a circular hole in the center for the light beams from the light source 4*a*. The front plate member 13*a* and the rear plate member 13*f* are coupled to each other via rod-like spacers denoted at reference numeral 13*i* in the drawing so that there is a gap between the back surface 13*e* of the front plate member 13*a* and the front surface 13*h* of the rear plate member 13*f*. In the illustrated example, the variable resistor 11 is attached to an upper part of the rear plate member 13*f*.

The link mechanism 12 in the illustrated example includes a lug part 12*a* fixed at the lower end to an upper part of the rotating body 9 and protruding upward, and a rod member 12*c* fixed at the rear end to the movable part of the variable resistor 11 and protruding forward, the front end of the rod member 12*c* being fitted into a retention hole 12*b* that is formed in the lug part 12*a* and long in an up and down direction. The configuration of this retention hole 12*b* realizes the movement in the left and right direction x of the movable part of the variable resistor 11 with a rotating movement of the rotating body 9. Any configuration will suffice as the link mechanism 12 as long as the rotating body 9 and the variable resistor 11 are operably connected such that a forward movement of the rotating body 9 causes the movable part of the variable resistor 11 to move in a direction in which the amount of current is increased and such that a backward movement of the rotating body 9 causes the movable part of the variable resistor 11 to move in a direction in which the amount of current is decreased, and the specific configuration is not limited to the illustrated example.

Reference numeral 15 in the drawing represents a lens provided to the passage part 13*b* of the front plate member 13*a*, and reference numeral 16 represents a lens provided to the passage part 13*g* of the rear plate member 13*f*.

Reference numeral 17 in the drawing represents a support arm 17 that forms an upper part of a support mechanism of the light projection device 1. The casing 3 is supported on the support arm 17 such as to be rotatable around a horizontal shaft 18 between one tube end 3*a* and the other tube end 3*b*. Reference numeral 19 in the drawing represents a vertical shaft rotatably connected to a lower part (not shown) of the support mechanism of the light projection device 1.

Turning the rotating body 9 that forms part of the light amount adjusting mechanism using the operating part 10 that forms part of the light amount adjusting mechanism causes the movable part of the variable resistor 11 operably connected to the rotating body 9 via the link mechanism 12 to move, to change the amount of current applied to the LED that forms the light source 4*a*. This allows for adjustment of the amount of light emitted from the light projection device 1.

Namely, even though this type of light projection device 1 uses LEDs for the light source 4*a*, the operating method for adjusting the amount of light emitted from the light projection device 1 according to this embodiment, and the feeling when operating the light projection device 1, can be made as close as possible to those of light projection devices 1 that use a conventional lamp such as a xenon lamp for the light source 4*a*.

The light amount adjusting mechanism can realize a state where no light is emitted from the light projection device 1 if, for example, the device is configured such that the light source 4*a* is switched off when the rotating body 9 is moved backward to a movement limit, i.e., if the amount of current applied to the LED used as the light source 4*a* becomes zero when the rotating body 9 is moved backward to the movement limit.

Figure 1:
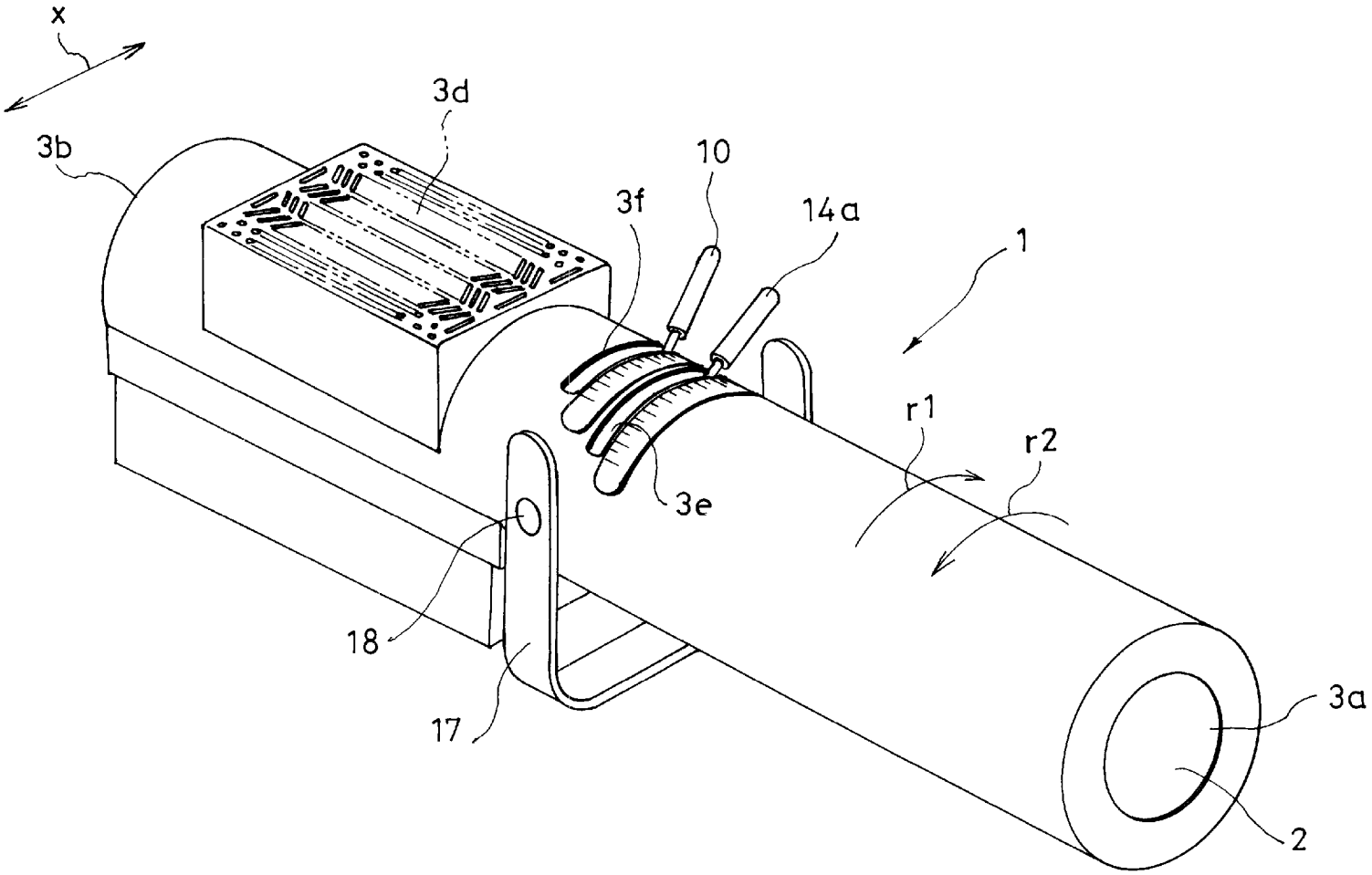
FIG. 1 is a perspective configuration diagram of a light projection device according to one embodiment of this invention.

In a case where the amount of light emitted from the light projection device 1 becomes largest when the operating part 10 that forms part of the light amount adjusting mechanism is rotated to a movement limit on the right side in FIG. 1, for example, the amount of light can be gradually decreased with leftward rotation of the operating part 10, and the light emission from the light projection device 1 can be stopped when the operating part is rotated to a movement limit on the left side.

It should go without saying that the present invention is not limited to the embodiment described above and includes all other embodiments that can achieve the object of the present invention.

DESCRIPTION OF REFERENCE SIGNS

3 Casing
3*c* Tube axis
9 Rotating body
10 Operating part
11 Variable resistor
12 Link mechanism The entire contents of the description, claims, drawings, and abstract of Japanese Patent Application No. 2018-26576 filed on Feb. 19, 2018 are hereby cited and incorporated into the disclosure in the description of the present invention.

The invention claimed is:

1. A light projection device comprising: a tubular casing having a light-emitting part at one tube end;

a light source configured with a light-emitting diode housed in the casing; and a light amount control mechanism positioned between the light source and the light-emitting part and controlling an amount of light output from the light-emitting part, the light amount control mechanism including:

a rotating body provided inside the casing and supported on the casing such as to be rotatable around a tube axis of the casing, an operating part attached to the rotating body such as to allow for rotary operation of the rotating body from outside the casing, a variable resistor allowing for current adjustment to increase and decrease an amount of current applied to the light-emitting diode, and a link mechanism operably connecting the rotating body and the variable resistor such that a forward movement of the rotating body causes a movable part of the variable resistor to move in a direction in which the amount of current is increased and such that a backward movement of the rotating body causes the movable part of the variable resistor to move in a direction in which the amount of current is decreased.

2. The light projection device according to claim 1, wherein the light source is switched off when the rotating body has been moved to a limit of backward movement.

3. The light projection device according to claim 1, wherein the rotating body is formed in an annular shape, with an inner part thereof being a passage part for a light beam from the light source.

4. The light projection device according to claim 1, further comprising a light beam diameter adjusting mechanism between the light amount control mechanism and the light-emitting part for a light beam emitted from the light-emitting part.

5. The light projection device according to claim 2, wherein the rotating body is formed in an annular shape, with an inner part thereof being a passage part for a light beam from the light source.

6. The light projection device according to claim 2, further comprising a light beam diameter adjusting mechanism between the light amount control mechanism and the light-emitting part for a light beam emitted from the light-emitting part.

7. The light projection device according to claim 3, further comprising a light beam diameter adjusting mechanism between the light amount control mechanism and the light-emitting part for a light beam emitted from the light-emitting part.

8. The light projection device according to claim 5, further comprising a light beam diameter adjusting mechanism between the light amount control mechanism and the light-emitting part for a light beam emitted from the light-emitting part.

* * * * *